US007467518B1

(12) United States Patent
Vermeersch

(10) Patent No.: US 7,467,518 B1
(45) Date of Patent: Dec. 23, 2008

(54) EXTERNALLY FUELED TRAPPED VORTEX CAVITY AUGMENTOR

(75) Inventor: Michael Louis Vermeersch, Hamilton, OH (US)

(73) Assignee: General Electric Company, Schenectady, NY (US)

( * ) Notice: Subject to any disclaimer, the term of this patent is extended or adjusted under 35 U.S.C. 154(b) by 464 days.

(21) Appl. No.: 11/330,782

(22) Filed: Jan. 12, 2006

(51) Int. Cl.
*F02K 3/10* (2006.01)
*F23R 3/18* (2006.01)

(52) U.S. Cl. ..... 60/776; 60/766

(58) Field of Classification Search ..... 60/761, 60/762, 765, 766
See application file for complete search history.

(56) References Cited

U.S. PATENT DOCUMENTS

| | | | | |
|---|---|---|---|---|
| 5,791,148 | A | 8/1998 | Burrus | |
| 5,813,221 | A | 9/1998 | Geiser et al. | |
| 5,857,339 | A | 1/1999 | Roquemore et al. | |
| 6,286,298 | B1 | 9/2001 | Burrus et al. | |
| 6,295,801 | B1 | 10/2001 | Burrus et al. | |
| 6,481,209 | B1 | 11/2002 | Johnson et al. | |
| 6,668,541 | B2 | 12/2003 | Rice et al. | |
| 6,735,949 | B1 | 5/2004 | Haynes et al. | |
| 7,225,623 | B2 * | 6/2007 | Koshoffer | 60/776 |
| 2002/0112482 | A1 | 8/2002 | Johnson et al. | |
| 2004/0216444 | A1 | 11/2004 | Lovett | |

OTHER PUBLICATIONS

AIAA 95-0810, "Performance of a Trapped-Vortex Combustor", 33rd Aerospace Sciences Meeting and Exhibit, Jan. 9-12, 1995 / Reno, NV, 15 pages.
U.S. Appl. No. 10/215,477, filed Aug. 5, 2002, "Augmenter With Trapped Vortex Flame Stabilizer".
U.S. Appl. No. 11/089,614, filed Mar. 25, 2005, "Augmenter Swirler Pilot".
U.S. Appl. No. 11/098,723, filed Apr. 4, 2005, "Air/Fuel Jet Stabilizers For Augmenter".
U.S. Appl. No. 11/209,918, filed Aug. 23, 2005, "Trapped Vortex Cavity Afterburner".

* cited by examiner

*Primary Examiner*—Michael Cuff
*Assistant Examiner*—Phutthiwat Wongwian
(74) *Attorney, Agent, or Firm*—William Scott Andes; Steven J. Rosen

(57) ABSTRACT

A gas turbine engine augmentor includes an externally fueled annular trapped vortex cavity having a cavity opening open to an exhaust flowpath and a sole source of fuel located upstream of the trapped vortex cavity and being operable for injecting fuel into the exhaust flowpath such that at least a portion of the fuel flows into the cavity through a cavity opening. An exemplary sole source of fuel includes fuel holes in fuel tubes within spray bars operable for injecting the fuel through heat shield openings in heat shields surrounding the tubes wherein the fuel holes are located in a radially outermost portion of the exhaust flowpath. The sole source of fuel may include circumferentially spaced apart radial spray bars and/or integral spray bars integral with radial flameholders and extending radially inwardly into the exhaust flowpath wherein the radial flameholders and radial spray bars are interdigitated.

40 Claims, 7 Drawing Sheets

EXTERNALLY FUELED TRAPPED VORTEX CAVITY AUGMENTOR

The Government has rights to this invention pursuant to Contract No. N00019-96-C-0176 awarded by the United States Department of Defense.

BACKGROUND OF THE INVENTION

The present invention relates generally to aircraft gas turbine engines with thrust augmenting afterburners and, more specifically, afterburners and augmentors with trapped vortex cavities.

High performance military aircraft typically include a turbofan gas turbine engine having an afterburner or augmentor for providing additional thrust when desired particularly for supersonic flight. The turbofan engine includes in downstream serial flow communication, a multistage fan, a multistage compressor, a combustor, a high pressure turbine powering the compressor, and a low pressure turbine powering the fan. A bypass duct surrounds and allows a portion of the fan air to bypass the multistage compressor, combustor, high pressure, and low pressure turbine.

During operation, air is compressed in turn through the fan and compressor and mixed with fuel in the combustor and ignited for generating hot combustion gases which flow downstream through the turbine stages which extract energy therefrom. The hot core gases are then discharged into an exhaust section of the engine which includes an afterburner from which they are discharged from the engine through a variable area exhaust nozzle.

Afterburners are located in exhaust sections of engines which includes an exhaust casing and an exhaust liner circumscribing a combustion zone. Fuel injectors (such as spraybars) and flameholders are mounted between the turbines and the exhaust nozzle for injecting additional fuel when desired during reheat operation for burning in the afterburner for producing additional thrust. Thrust augmentation or reheat using such fuel injection is referred to as wet operation while operating dry refers to not using the thrust augmentation. The annular bypass duct extends from the fan to the afterburner for bypassing a portion of the fan air around the core engine to the afterburner. This bypass air is mixed with the core gases and fuel from the spraybars prior and ignited and combusted prior to discharge through the exhaust nozzle. The bypass air is also used in part for cooling the exhaust liner.

Various types of flameholders are known and provide local low velocity recirculation and stagnation regions therebehind, in regions of otherwise high velocity core gases, for sustaining and stabilizing combustion during reheat operation. Since the core gases are the product of combustion in the core engine, they are initially hot, and are further heated when burned with the bypass air and additional fuel during reheat operation. Augmentors currently are used to maximize thrust increases and tend to be full stream and consume all available oxygen in the combustion process yielding high augmentation ratios for example about 70%.

In regions immediately downstream of the flameholder, the gas flow is partially recirculated and the velocity is less than the rate of flame propagation. In these regions, there will be a stable flame existing which can ignite new fuel as it passes. Unfortunately, flameholders in the gas stream inherently cause flow losses and reduced engine efficiency. Several modern gas turbine engine's and designs include radially extending spray bars and flameholders in an effort to improve flame stability and reduce the flow losses. Radial spray bars integrated with radial flameholders are disclosed in U.S. Pat. Nos. 5,396,763 and 5,813,221. Radial spray bars disposed between radial flameholders having integrated radial spray bars have been incorporated in the GE F414 and GE F110-132 aircraft gas turbine engines. This arrangement provides additional dispersion of the fuel for more efficient combustion and unload fueling of the radial flameholders with the integrated radial spray bars so that they do not blowout and or have unstable combustion due to excess fueling.

Since fuel is typically injected upstream of the flameholders, undesirable auto-ignition of the fuel and combustion which might occur upstream of the flameholders causes flameholder distress which also significantly reduces the useful life of the flameholders. Since V-gutter flameholders are suspended within the core gases, they are more difficult to effectively cool and, typically, experience circumferential variation in temperature, which correspondingly effects thermal stress, which also decreases the useful life thereof. V-gutter flameholders have limited flameholding capability and their aerodynamic performance and characteristics negatively impact the size, performance, and thrust capability of the engine. This is, in part, due to the combustion zone having sufficient length to allow substantially complete combustion of the fuel added by the spraybars prior to discharge through the nozzle and wide ranging flight speeds and Mach numbers. It is, therefore, highly desirable to have an augmentor with a flame stabilization apparatus that has better performance characteristics than previous afterburners or augmentors.

BRIEF DESCRIPTION OF THE INVENTION

A gas turbine engine augmentor includes an externally fueled annular trapped vortex cavity having a cavity opening open to an exhaust flowpath. The cavity opening extends between cavity forward and aft walls at a radially inner end of the cavity. A sole source of fuel is located upstream of the trapped vortex cavity and is operable for injecting fuel into the exhaust flowpath such that at least a portion of the fuel flows into the cavity through the cavity opening.

In an exemplary embodiment of the augmentor, the sole source of fuel includes spray bars. Fuel tubes in the spray bars and fuel holes in the tubes are operable for injecting the fuel through heat shield openings in heat shields surrounding the tubes. The fuel holes and the heat shield openings are located in a radially outermost portion of the exhaust flowpath. A plurality of circumferentially spaced apart radial flameholders extend radially inwardly into the exhaust flowpath and include integral spray bars and radial spray bars extending radially inwardly into the exhaust flowpath. The integral spray bars are integral with the radial flameholders. The radial flameholders may be circumferentially interdigitated with radial spray bars.

A more particular embodiment of the augmentor includes a bypass duct surrounding at least a portion of the exhaust flowpath. The vortex cavity includes air injection first holes in the cavity forward wall at a radial position along the forward wall near the opening and air injection second holes in the cavity aft wall positioned radially near a cavity radially outer wall spaced radially outwardly of the opening. The air injection first and second holes are open to a bypass flowpath within the bypass duct.

A turbofan gas turbine engine has a fan section upstream of a core engine in which the core engine includes in serial downstream flow communication a high pressure compressor, a combustor, and a high pressure turbine. A low pressure turbine is located downstream of the core engine and an annular bypass duct containing a bypass flowpath circumscribes the core engine. The gas turbine engine augmentor is located downstream of the low pressure turbine and includes the externally fueled annular trapped vortex cavity.

A method for operating a gas turbine engine augmentor having the externally fueled annular trapped vortex cavity includes supplying all of the fuel supplied to the trapped vortex cavity by injecting fuel into the exhaust flowpath from a sole source of fuel located upstream of the trapped vortex cavity such that at least a portion of the fuel flows through the cavity opening into the vortex cavity during operation of the augmentor. An exemplary embodiment of the method includes injecting the fuel into the exhaust flowpath from the spray bars and, more particularly, from the fuel tubes in the spray bars though fuel holes in the tubes and through heat shield openings in heat shields surrounding the tubes. Bypass air flowing through a bypass duct surrounding at least a portion of the exhaust flowpath may be used for injecting vortex driving aftwardly injected air from the bypass air through air injection first holes in the cavity forward wall at a radial position along the forward wall near the opening and injecting vortex driving forwardly injected air through air injection second holes in the cavity aft wall positioned radially near a cavity radially outer wall spaced radially outwardly of the opening.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
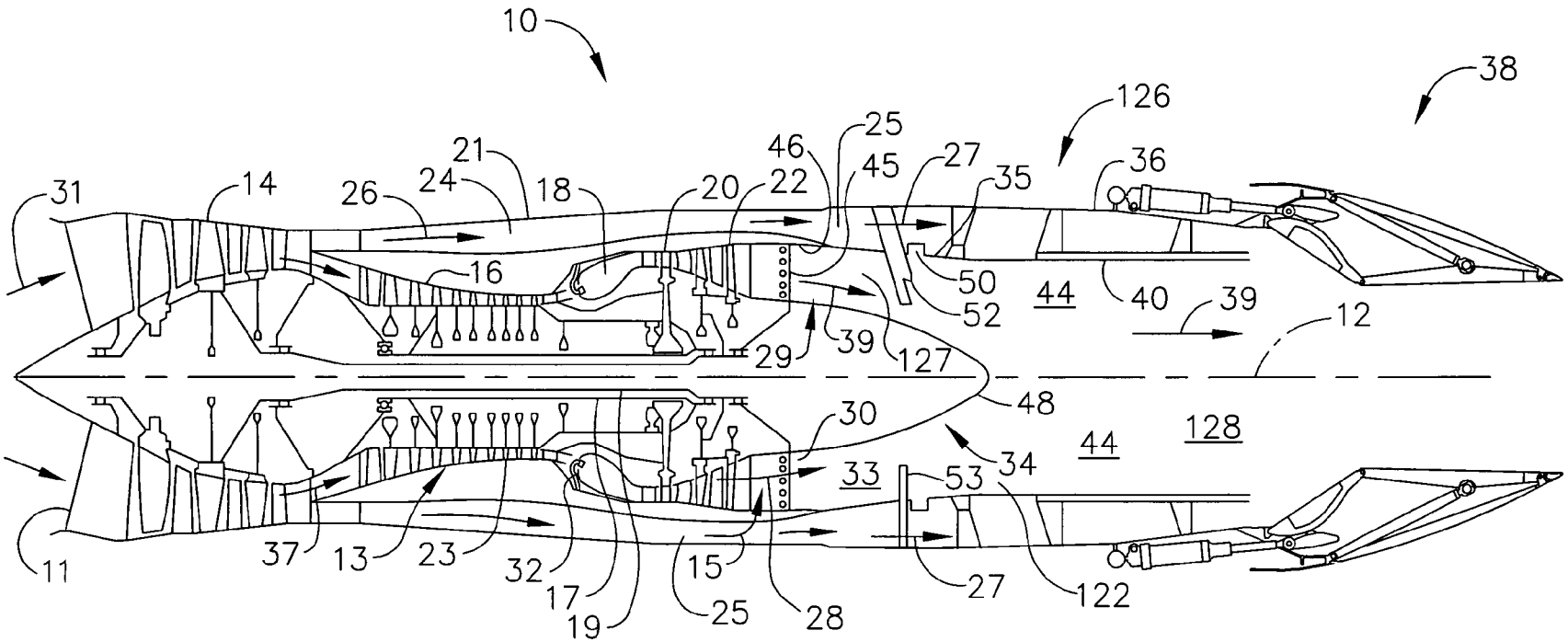
FIG. 1 is an axial sectional view illustration through an exemplary turbofan gas turbine engine having an augmentor with an externally fueled vortex cavity.

Illustrated in FIG. 1 is an exemplary medium bypass ratio turbofan gas turbine engine 10 for powering an aircraft (not shown) in flight. The engine 10 is axisymmetrical about a longitudinal or axial centerline axis 12 and has a fan section 14 upstream of a core engine 13. The core engine 13 includes, in serial downstream flow communication, a multistage axial high pressure compressor 16, an annular combustor 18, and a high pressure turbine 20 suitably joined to the high pressure compressor 16 by a high pressure drive shaft 17. Downstream of the core engine 13 is a multistage low pressure turbine 22 suitably joined to the fan section 14 by a low pressure drive shaft 19. The core engine 13 is contained within a core engine casing 23 and an annular bypass duct 24 containing a bypass flowpath 25 circumscribed about the core engine 13. An engine casing 21 circumscribes the bypass duct 24 which extends from the fan section 14 downstream past the low pressure turbine 22.

Engine air 25 enters the engine through an engine inlet 11 and is initially pressurized as it flows downstream through the fan section 14 with an inner portion thereof referred to as core engine air 37 flowing through the high pressure compressor 16 for further compression. An outer portion of the engine air is referred to as bypass air 26 and is directed to bypass the core engine 13 and flow through the bypass duct 24. The core engine air is suitably mixed with fuel by main combustor fuel injectors 32 and carburetors in the combustor 18 and ignited for generating hot combustion gases which flow through the turbines 20, 22. The hot combustion gases are discharged through an annular core outlet 30 as core gases 28 into a core stream flowpath 127 which is an upstream portion of an exhaust flowpath 128 extending downstream and aftwardly of the turbines 20, 22 and through a diffuser 29 which is aft and downstream of the turbines 20, 22 in the engine 10. The core stream flowpath 127 is located radially inwardly of the bypass duct 24.

The diffuser 29 includes a diffuser duct 33 circumscribed by an annular radially outer diffuser liner 46 and is used to decrease the velocity of the core gases 28 as they enter an augmentor 34 of the engine. The centerline axis 12 is also the centerline axis of the augmentor 34 which is circumferentially disposed around the centerline axis 12. A converging centerbody 48 extending aft from the core outlet 30 and partially into the augmentor 34 radially inwardly bounds the diffuser duct 33. The diffuser 29 is axially spaced apart upstream or forwardly of a forward end 35 of a combustion liner 40 inside the exhaust casing 36. A combustion zone 44 in the exhaust flowpath 128 is surrounded by the combustion liner 40 and located radially inwardly from the bypass duct 24 and downstream and aft of the augmentor 34.

Figure 2:
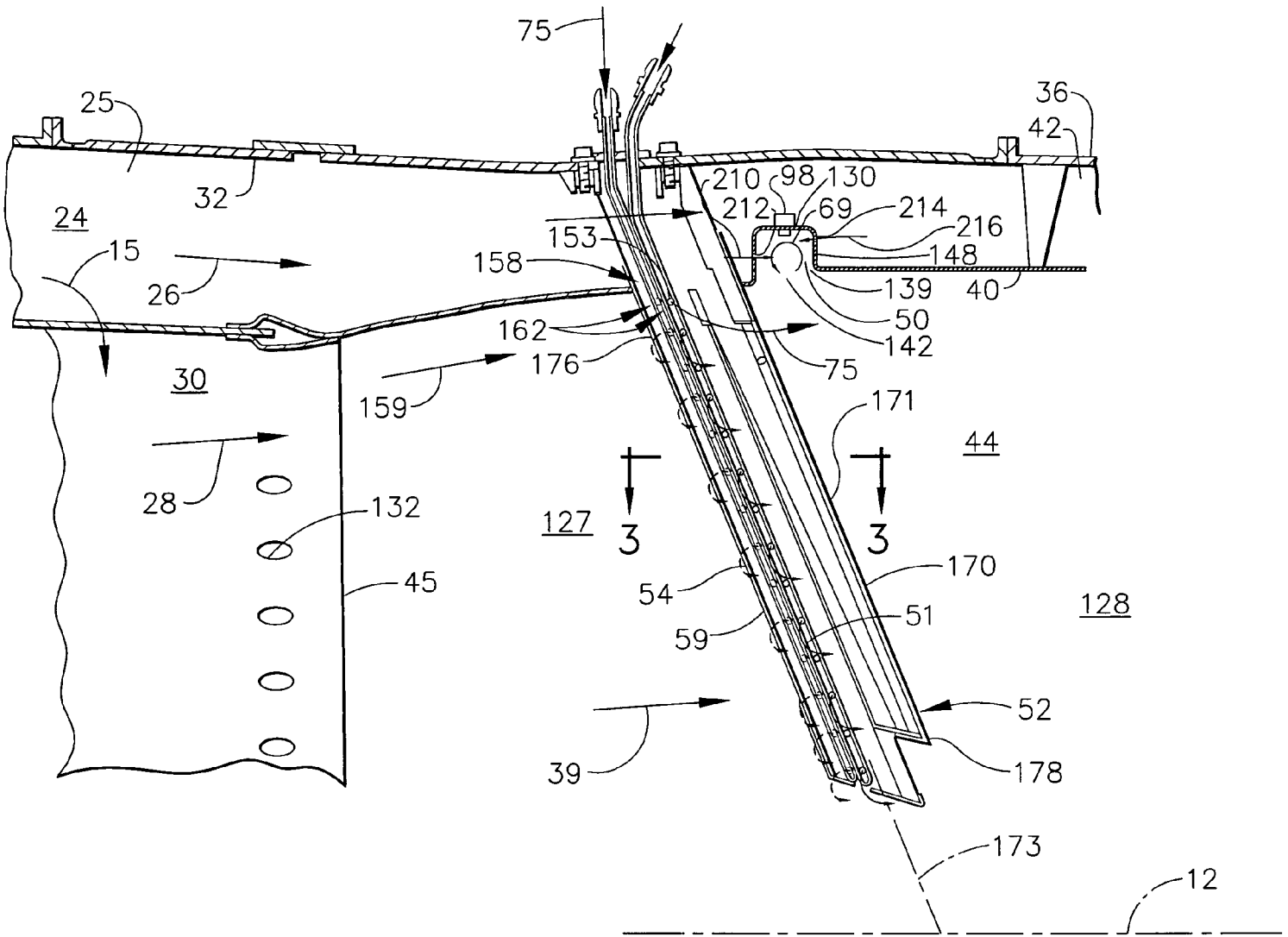
FIG. 2 is an enlarged axial sectional view illustration of a radial flameholder and the vortex cavity in the augmentor illustrated in FIG. 1.

Referring to FIGS. 1 and 2, exhaust vanes 45 extend radially across the exhaust flowpath 128. The exhaust vanes 45 are typically hollow and curved. The hollow exhaust vanes 45 are designed to receive a first portion 15 of the bypass air 26 and flow it into the exhaust flowpath 128 through air injection holes 132. The bypass air 26 and the core gases 28 mix together to form an exhaust flow 39. The exhaust section 126 includes an annular exhaust casing 36 disposed co-axially with and suitably attached to the corresponding engine casing 21 and surrounding the exhaust flowpath 128. Mounted to the aft end of the exhaust casing 36 is a conventional variable area converging-diverging exhaust nozzle 38 through which the exhaust flow 39 are discharged during operation.

Figure 4:
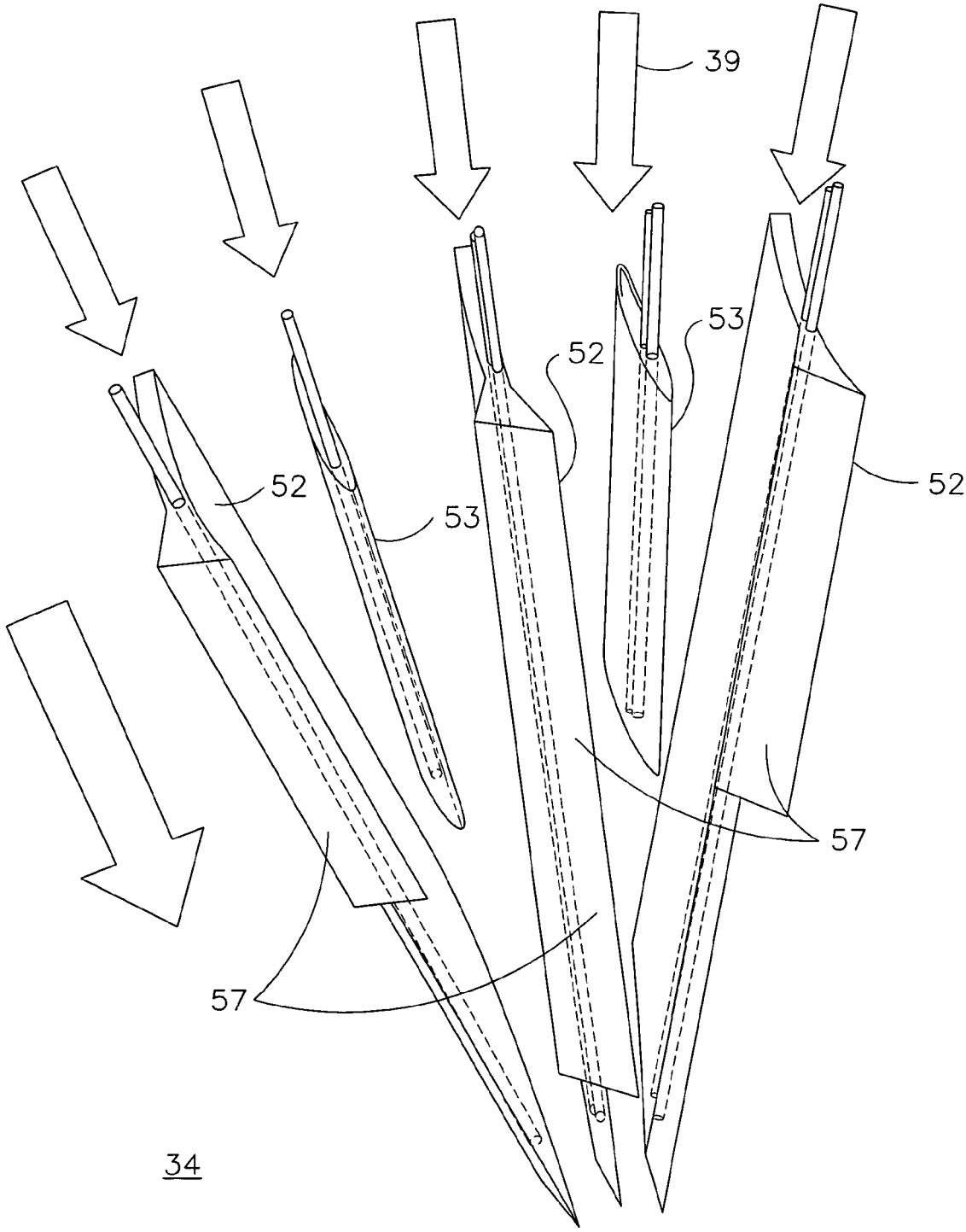
FIG. 4 is a perspective view illustration of a portion of radial spray bars disposed between the radial flameholders in the augmentor illustrated in FIG. 3.

The exhaust section 126 further includes an annular exhaust combustion liner 40 spaced radially inwardly from the exhaust casing 36 to define therebetween an annular cooling duct 42 disposed in flow communication with the bypass duct 24 for receiving therefrom a second portion 27 of the bypass air 26. An exhaust section combustion zone 44 within the exhaust flowpath 128 is located radially inwardly from the liner 40 and the bypass duct 24 and downstream or aft of the core engine 13 and the low pressure turbine 22. The exemplary embodiment of the augmentor 34 illustrated herein includes a plurality of circumferentially spaced apart radial flameholders 52 extending radially inwardly from the diffuser wall 46 into the exhaust flowpath 128. Each of the radial flameholders 52 includes an integral spray bar 59. The radial flameholders 52 are circumferentially interdigitated with radial spray bars 53, i.e. one radial spray bar 53 between each circumferentially adjacent pair 57 of the radial flameholders 52, as illustrated in FIG. 4.

Figure 3:
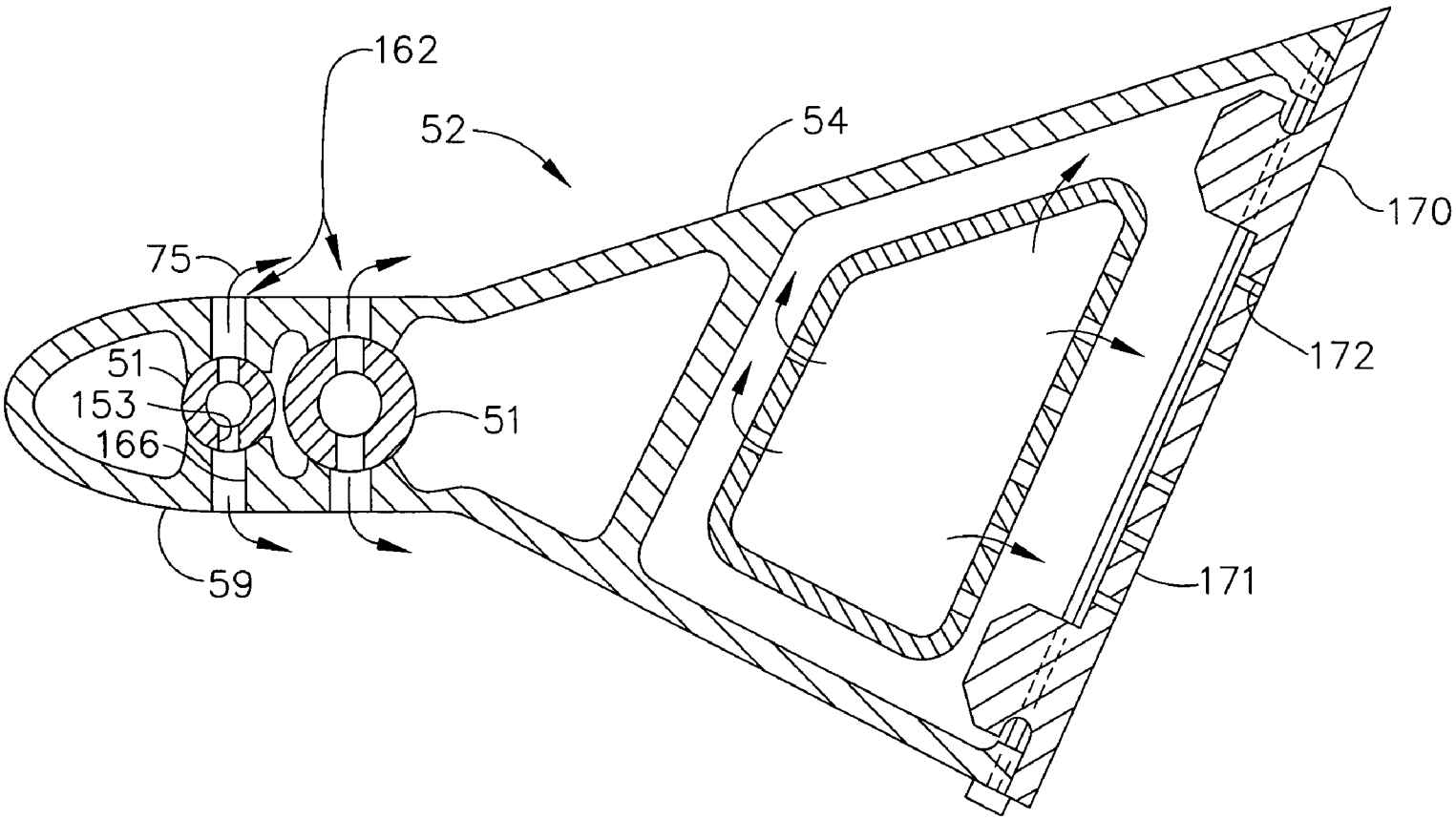
FIG. 3 is a sectional view illustration through 3-3 of the radial flameholder illustrated in FIG. 2.

Referring further to FIGS. 2 and 3, the integral spray bar 59 in each radial flameholder 52 includes one or more fuel tubes 51 therein. The fuel tubes 51 are suitably joined in flow communication with a conventional fuel supply (not illustrated herein) which is effective for channeling fuel 75 to each of the fuel tubes for injecting the fuel 75 into the exhaust flowpath 128 downstream of the exhaust vanes 45 and upstream of the combustion zone 44. Similar air cooled flameholders are disclosed in detail in U.S. Pat. Nos. 5,813,221 and 5,396,763 both of which are assigned to the present assignee and incorporated herein by reference.

Each of the radial flameholders 52 include a flameholder heat shield 54 surrounding the fuel tubes 51. Fuel holes 153 in the fuel tubes 51 are operable for injecting fuel 75 through heat shield openings 166 in the flameholder heat shield 54 into the exhaust flowpath 128. A generally aft and downstream facing flameholding wall 170 having a flat outer surface 171 includes film cooling holes 172 and is located on an aft end of the flameholder heat shield 54. The radial flameholders 52 are swept downstream from radially outer ends 176 towards radially inner ends 178 of the radial flameholders as illustrated in FIG. 2. The flameholding wall 170 and the flat outer surface 171 are canted about a wall axis 173 that is angled with respect to the centerline axis 12 of the engine.

Referring again to FIG. 4, the augmentor fuel radial spray bars 53 are circumferentially disposed between at least some of the radial flameholders 52. The augmentor 34 is illustrated herein with one radial spray bar 53 between each circumferentially adjacent pair of the radial flameholders 52. Other embodiments of the augmentor 34 can employ more than one radial spray bar 53 between each radial flameholder 52. Yet other embodiments of the augmentor 34 can employ less radial spray bars 53 in which some of the adjacent pairs of the radial flameholders 52 have no radial spray bar 53 therebetween and others of the adjacent pairs of the radial flameholders 52 at least one radial spray bar 53 therebetween.

Figure 5:
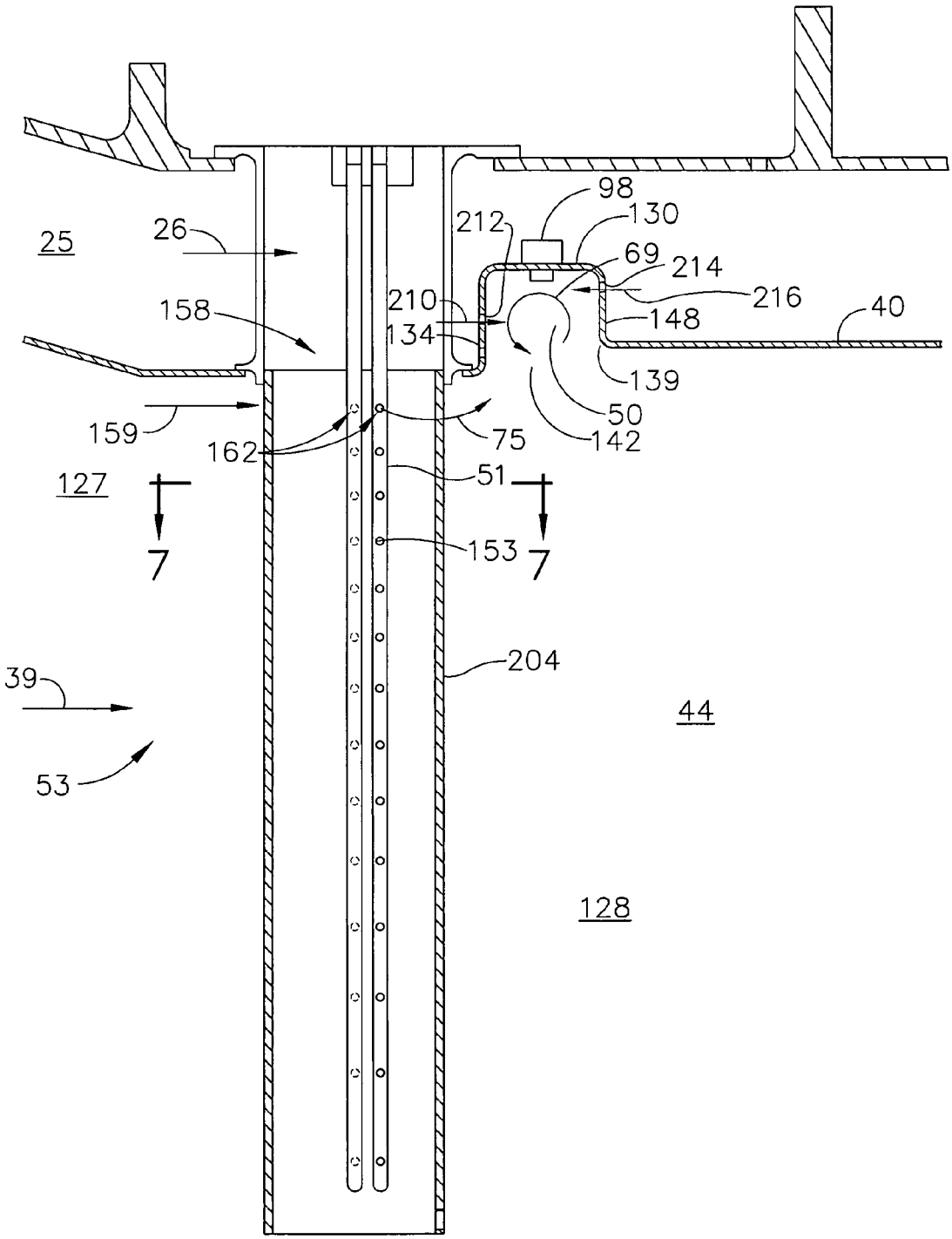
FIG. 5 is an enlarged axial sectional view illustration of the radial spray bar illustrated in FIGS. 1 and 4.
Figure 6:
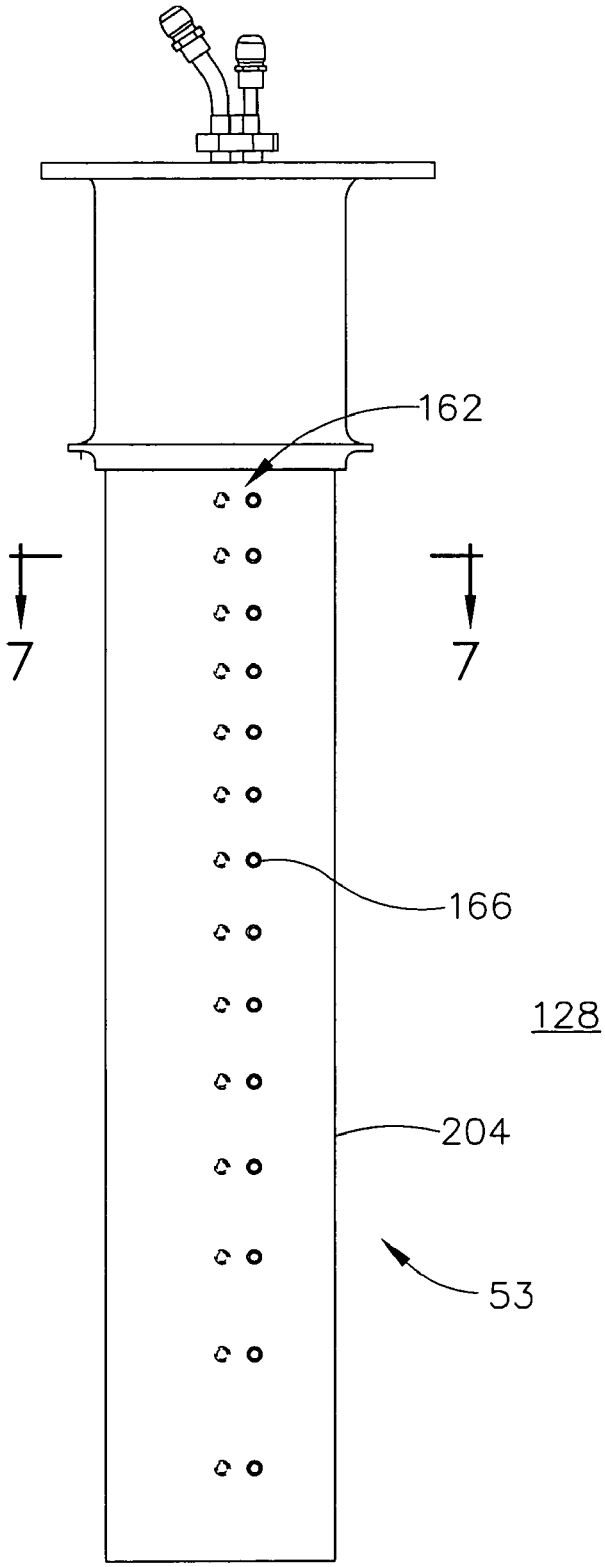
FIG. 6 is an enlarged elevational view illustration of the radial spray bar illustrated in FIGS. 1, 4, and 5.
Figure 7:
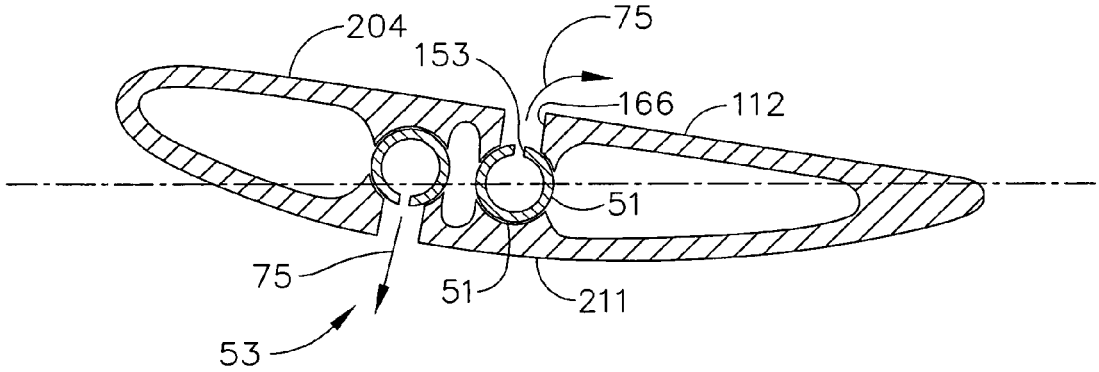
FIG. 7 is a sectional view illustration through 7-7 of the radial spray bar illustrated in FIG. 6.

Referring to FIGS. 5, 6, and 7, each of the radial spray bars 53 includes a spray bar heat shield 204 surrounding one or more fuel tubes 51. The radial spray bars 53 are illustrated herein as having two fuel tubes 51. Fuel holes 153 in the fuel tubes 51 are operable for injecting fuel 75 through openings 166 in the spray bar heat shields 204 into the exhaust flowpath 128. Referring back to FIGS. 1 and 2, the first portion 15 of the bypass air 26 mixes with core gases 28 in the exhaust flowpath 128 to form the exhaust flow 39 and further downstream with other portions of the bypass air 26. The augmentor 34 uses the oxygen in the exhaust flowpath 128 for combustion.

Illustrated in FIG. 7, is an airfoil cross-section 211 of the spray bar heat shields 204. The airfoil cross-section 211 illustrates a wall 112 of the airfoil shaped spray bar heat shields 204. Fuel 75 from the fuel tubes 51 of the radial spray bars 53 and from the fuel tubes 51 of the radial flameholders 52 inject the fuel 75 into the exhaust flowpath 128 downstream of the exhaust vanes 45 forming an fuel/air mixture for combustion in the combustion zone 44. The fuel 75 from the fuel holes 153 in the fuel tubes 51 of the radial flameholders 52 and the radial spray bars 53 is combusted in the combustion zone 44 for thrust augmentation from the exhaust nozzle 38.

The fuel/air mixture is ignited and stabilized by an externally fueled annular trapped vortex cavity 50. The annular trapped vortex cavity 50 may be circumferentially segmented. The trapped vortex cavity 50 is utilized to produce an annular rotating vortex 69 of a fuel and air mixture. The trapped vortex cavity 50 includes a cavity forward wall 134, a cavity radially outer wall 130, and a cavity aft wall 148. A cavity opening 142 extends between the cavity forward and aft walls 134 and 148 at a radially inner end 139 of the trapped vortex cavity 50. All of the fuel supplied to the externally fueled annular trapped vortex cavity 50 comes from outside the cavity 50 through the cavity opening 142.

The cavity opening 142 is open to combustion zone 44 in the exhaust flowpath 128 and is spaced radially apart and inwardly of the cavity radially outer wall 130. Vortex driving aftwardly injected air 210 from the bypass air 26 is injected through air injection first holes 212 in the cavity forward wall 134 at a radial position along the forward wall near the opening 142 at the radially inner end 139 of the trapped vortex cavity 50. Vortex driving forwardly injected air 216 is injected through air injection second holes 214 in the cavity aft wall 148 positioned radially near the cavity radially outer wall 130.

The circumferentially disposed annular trapped vortex cavity 50, illustrated in FIGS. 1, 2, and 5, faces radially inwardly towards the centerline 12 in the combustion zone 44 so as to be in direct unobstructed fluid communication with the combustion zone 44. The annular trapped vortex cavity 50 is located slightly aft and downstream of the radial spray bars 53 and the radial flameholders 52 at a radially outer portion 122 of the combustion zone 44 for maximizing flame ignition and stabilization in the combustion zone 44 during thrust augmentation or reheat. As such, the trapped vortex cavity 50 is aerodynamically closely coupled to a radially outermost portion 158 of fuel holes 153 in the fuel tubes 51 of the radial flameholders 52 and a radially outermost portion 158 of fuel holes 153 in the fuel tubes 51 of the radial spray bars 53. The portion 158 of fuel holes 153 are located within a radially outermost portion 158 of the core stream flowpath 127 or the exhaust flowpath 128. There may be other more radially outer located fuel holes 153 that are not in the core stream flowpath 127 or the exhaust flowpath 128 such as in the bypass duct 24.

The radially outermost portion 158 of fuel holes 153 in the fuel tubes 51 and in the fuel tubes 51 also serve as and exemplify vortex cavity fuel injectors 162 in the radially outermost portion 158 of the core stream flowpath 127 or the exhaust flowpath 128. The vortex 69 produced in the trapped vortex cavity 50 draws in fuel 75 from the radially outermost portion 158 of fuel holes 153 by entraining the fuel 75 in air from the diffuser duct 33 entering the augmentor 34. As air in the vortex 69 is pumped out of the trapped vortex cavity 50, a radially outer airflow 159 from the diffuser duct 33 entering the augmentor 34 is drawn into the vortex cavity 50 and the radially outer airflow 159 entrains the fuel 75 from the radially outermost portion 158 of fuel holes 153. All of the fuel 75 fed into the externally fueled annular trapped vortex cavity 50 comes from outside the cavity 50 through the cavity opening 142 entrained in the radially outer airflow 159 which is drawn into the vortex cavity 50. Thus, the radially outermost portion 158 of fuel holes 153 in the fuel tubes 51 of the radial flameholders 52 and the radially outermost portion of fuel holes 153 in the fuel tubes 51 of the radial spray bars 53 are the sole source of the fuel 75 for the trapped vortex cavity 50. At least one igniter 98 is operably disposed within the trapped vortex cavity 50 for igniting a fuel and air mixture in vortex cavity which then expands into the combustion zone 44 igniting the fuel and air mixture therein. Only one igniter is illustrated in the FIGS. but more than one may be used. The externally fueled annular trapped vortex cavity 50 thus eliminates the need for feeding fuel into the vortex cavity using extra vortex cavity fuel injectors and air spray holes through the walls of the vortex cavity and in the bypass duct.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention.

Accordingly, what is desired to be secured by Letters Patent of the United States is the invention as defined and differentiated in the following claims:

What is claimed:

1. A gas turbine engine augmentor comprising:

an externally fueled annular trapped vortex cavity having a cavity opening open to an exhaust flowpath, the cavity opening extending between cavity forward and aft walls at a radially inner end of the cavity, and a sole source of fuel located upstream of the trapped vortex cavity and being operable for injecting fuel into the exhaust flowpath such that at least a portion of the fuel flows into the cavity through the cavity opening.

2. An augmentor according to claim 1 further comprising the sole source of fuel including spray bars.

3. An augmentor according to claim 2 further comprising fuel tubes in the spray bars and fuel holes in the tubes being operable for injecting the fuel through heat shield openings in heat shields surrounding the tubes.

4. An augmentor according to claim 3 further comprising the fuel holes and the heat shield openings being located in a radially outermost portion of the exhaust flowpath.

5. An augmentor according to claim 2 further comprising:

a plurality of circumferentially spaced apart radial flameholders extending radially inwardly into the exhaust flowpath, the spray bars including integral spray bars and radial spray bars extending radially inwardly into the exhaust flowpath, and the integral spray bars being integral with the radial flameholders.

6. An augmentor according to claim 5 further comprising fuel tubes in the spray bars and fuel holes in the tubes being operable for injecting the fuel through heat shield openings in heat shields surrounding the tubes.

7. An augmentor according to claim 5 further comprising the radial flameholders being circumferentially interdigitated with radial spray bars.

8. An augmentor according to claim 1 further comprising:

a bypass duct surrounding at least a portion of the exhaust flowpath, air injection first holes in the cavity forward wall at a radial position along the forward wall near the opening, air injection second holes in the cavity aft wall positioned radially near a cavity radially outer wall spaced radially outwardly of the opening, and the air injection first and second holes open to a bypass flowpath within the bypass duct.

9. An augmentor according to claim 8 further comprising the sole source of fuel including spray bars extending radially inwardly into the exhaust flowpath.

10. An augmentor according to claim 9 further comprising fuel tubes in the spray bars and fuel holes in the tubes being operable for injecting the fuel through heat shield openings in heat shields surrounding the tubes.

11. An augmentor according to claim 10 further comprising the fuel holes and the heat shield openings being located in a radially outermost portion of the exhaust flowpath.

12. An augmentor according to claim 9 further comprising:

a plurality of circumferentially spaced apart radial flameholders extending radially inwardly into the exhaust flowpath, the spray bars including integral spray bars and radial spray bars extending radially inwardly into the exhaust flowpath, and the integral spray bars being integral with the radial flameholders.

13. An augmentor according to claim 12 further comprising fuel tubes in the spray bars and fuel holes in the tubes being operable for injecting the fuel through heat shield openings in heat shields surrounding the tubes.

14. An augmentor according to claim 13 further comprising the fuel holes and the heat shield openings being located in a radially outermost portion of the exhaust flowpath.

15. An augmentor according to claim 12 further comprising the radial flameholders being circumferentially interdigitated with radial spray bars.

16. An augmentor according to claim 15 further comprising fuel tubes in the spray bars and fuel holes in the tubes being operable for injecting the fuel through heat shield openings in heat shields surrounding the tubes.

17. An augmentor according to claim 16 further comprising the fuel holes and the heat shield openings being located in a radially outermost portion of the exhaust flowpath.

18. A turbofan gas turbine engine comprising:

a fan section upstream of a core engine;

the core engine including in serial downstream flow communication a high pressure compressor, a combustor, and a high pressure turbine;

a low pressure turbine downstream of the core engine;

an annular bypass duct containing a bypass flowpath circumscribing the core engine;

a gas turbine engine augmentor downstream of the low pressure turbine;

the augmentor including an externally fueled annular trapped vortex cavity having a cavity opening open to an exhaust flowpath;

the cavity opening extending between cavity forward and aft walls at a radially inner end of the cavity; and a sole source of fuel located upstream of the trapped vortex cavity and being operable for injecting fuel into the exhaust flowpath such that at least a portion of the fuel flows into the cavity through the cavity opening.

19. An engine according to claim 18 further comprising:

a bypass duct surrounding at least a portion of the exhaust flowpath, air injection first holes in the cavity forward wall at a radial position along the forward wall near the opening, air injection second holes in the cavity aft wall positioned radially near a cavity radially outer wall spaced radially outwardly of the opening, and the air injection first and second holes open to a bypass flowpath within the bypass duct.

20. An engine according to claim 19 further comprising the sole source of fuel including spray bars extending radially inwardly into the exhaust flowpath.

21. An engine according to claim 20 further comprising fuel tubes in the spray bars and fuel holes in the tubes being operable for injecting the fuel through heat shield openings in heat shields surrounding the tubes.

22. An engine according to claim 21 further comprising the fuel holes and the heat shield openings being located in a radially outermost portion of the exhaust flowpath.

23. An engine according to claim 20 further comprising:

a plurality of circumferentially spaced apart radial flameholders extending radially inwardly into the exhaust flowpath, the spray bars including integral spray bars and radial spray bars extending radially inwardly into the exhaust flowpath, and the integral spray bars being integral with the radial flameholders.

24. An engine according to claim 23 further comprising fuel tubes in the integral and radial spray bars and fuel holes in the tubes being operable for injecting the fuel through heat shield openings in heat shields surrounding the tubes.

25. An engine according to claim 24 further comprising the fuel holes and the heat shield openings being located in a radially outermost portion of the exhaust flowpath.

26. An engine according to claim 23 further comprising the radial flameholders being circumferentially interdigitated with radial spray bars.

27. An engine according to claim 26 further comprising fuel tubes in the spray bars and fuel holes in the tubes being operable for injecting the fuel through heat shield openings in heat shields surrounding the tubes.

28. An engine according to claim 27 further comprising the fuel holes and the heat shield openings being located in a radially outermost portion of the exhaust flowpath.

29. A method for operating a gas turbine engine augmentor having an externally fueled annular trapped vortex cavity with a cavity opening open to an exhaust flowpath and the cavity opening extending between cavity forward and aft walls at a radially inner end of the cavity, the method comprising supplying all of the fuel supplied to the trapped vortex cavity by injecting fuel into the exhaust flowpath from a sole source of fuel located upstream of the trapped vortex cavity such that at least a portion of the fuel flows through the cavity opening into the vortex cavity during operation of the augmentor.

30. A method according to claim 29 further comprising injecting the fuel into the exhaust flowpath from spray bars.

31. A method according to claim 30 further comprising injecting the fuel into the exhaust flowpath from fuel tubes in the spray bars though fuel holes in the tubes and through heat shield openings in heat shields surrounding the tubes.

32. A method according to claim 31 further comprising injecting the fuel into the exhaust flowpath through the fuel holes and the heat shield openings in a radially outermost portion of the exhaust flowpath.

33. A method according to claim 32 further comprising injecting the fuel into the exhaust flowpath through radial spray bars and/or integral spray bars extending radially inwardly into the exhaust flowpath wherein the augmentor further includes a plurality of circumferentially spaced apart radial flameholders extending radially inwardly into the exhaust flowpath and the integral spray bars are integral with the radial flameholders.

34. A method according to claim 33 wherein the radial flameholders are circumferentially interdigitated with radial spray bars.

35. A method according to claim 29 further comprising:

flowing bypass air through a bypass duct surrounding at least a portion of the exhaust flowpath, injecting vortex driving aftwardly injected air from the bypass air through air injection first holes in the cavity forward wall at a radial position along the forward wall near the opening, and injecting vortex driving forwardly injected air through air injection second holes in the cavity aft wall positioned radially near a cavity radially outer wall spaced radially outwardly of the opening.

36. A method according to claim 35 further comprising injecting the fuel into the exhaust flowpath from spray bars.

37. A method according to claim 36 further comprising injecting the fuel into the exhaust flowpath from fuel tubes in the spray bars though fuel holes in the tubes and through heat shield openings in heat shields surrounding the tubes.

38. A method according to claim 37 further comprising injecting the fuel into the exhaust flowpath through the fuel holes and the heat shield openings in a radially outermost portion of the exhaust flowpath.

39. A method according to claim 38 further comprising injecting the fuel into the exhaust flowpath through radial spray bars and/or integral spray bars extending radially inwardly into the exhaust flowpath wherein the augmentor further includes a plurality of circumferentially spaced apart radial flameholders extending radially inwardly into the exhaust flowpath and the integral spray bars are integral with the radial flameholders.

40. A method according to claim 39 wherein the radial flameholders are circumferentially interdigitated with radial spray bars.

* * * * *